US006310586B1

(12) United States Patent
Takahashi et al.

(10) Patent No.: US 6,310,586 B1
(45) Date of Patent: Oct. 30, 2001

(54) WIDEBAND ANTENNA MOUNTABLE IN VEHICLE CABIN

(75) Inventors: Toshiyuki Takahashi, Saitama-ken; Tomoki Ikeda, Fukushima-ken, both of (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/797,036

(22) Filed: Mar. 1, 2001

(30) Foreign Application Priority Data

Mar. 2, 2000 (JP) ..... 12-057235

(51) Int. Cl.[7] ..... H01Q 1/42

(52) U.S. Cl. ..... 343/872; 343/700 MS; 343/713; 343/906

(58) Field of Search ..... 343/700 MS, 713, 343/702, 872, 906

(56) References Cited

U.S. PATENT DOCUMENTS 5,355,142 * 10/1994 Marshall et al. ..... 343/700 MS
5,757,327 * 5/1998 Yajima et al. ..... 343/713
5,900,840 * 5/1999 Yajima ..... 343/713
6,246,368 * 6/2001 Deming et al. ..... 343/700 MS

FOREIGN PATENT DOCUMENTS 5-029821 2/1993 (JP) .
12-040908 2/2000 (JP) .

* cited by examiner

*Primary Examiner*—Tan Ho
(74) *Attorney, Agent, or Firm*—Brinks Hofer Gilson & Lione

(57) ABSTRACT

An antenna includes a casing which is constructed of a first case and a second case. In the first case, a radiation conductor unit including an electricity-supplying conductor and a plurality of radiation conductors having different lengths and a grounded conductor unit including a ground conductor are contained. The radiation conductors extend in parallel to each other from the electricity-supplying conductor. A first receiving portion provided in the electricity-supplying conductor and a holding portion and a second receiving portion provided in the grounded conductor unit are arranged in a linear manner. A coaxial cable is introduced from the upper side, and an inner conductor and an outer conductor of the coaxial cable are connected to the first and the second receiving portions, respectively. In addition, the holding portion holds an insulator of the coaxial cable. The opening at the upper side of the first case is then covered by the second case.

5 Claims, 8 Drawing Sheets

WIDEBAND ANTENNA MOUNTABLE IN VEHICLE CABIN

BACKGROUND OF THE INVENTION

1. Field of the Invention

The present invention relates to antennas, and more particularly relates to an on-board antenna used for receiving terrestrial television broadcast signals, etc.

2. Description of the Related Art

A conventional on-board antenna 50 for receiving terrestrial television broadcast signals is shown in FIG. 7. This conventional antenna 50 includes a rod-shaped radiation conductor 51 which is adjusted so as to resonate at a desired frequency. The angle between the radiation conductor 51 and a pedestal 52 is freely adjusted by using a supporting portion 53, which functions as a fulcrum. As shown in FIGS. 8A and 8B, this antenna 50 is attached on a rear window 61 or on a roof 62 of a vehicle 60.

Generally, to solve the problem of fading, which particularly occurs when signals are received by a moving antenna, a diversity receiving system is adopted in vehicles. In this system, a plurality of the antennas shown in FIG. 7 are used, and one of the antennas which exhibits the highest receiving level is selected.

With respect to the conventional antennas as described above, the operational bandwidth of a single antenna is not sufficiently wide. Thus, when a wide bandwidth must be covered, as in a case of receiving television broadcast signals, multiple antennas having different operational bandwidths are prepared. In addition, external circuits such as tuning circuits and amplifying circuits are attached. Accordingly, there has been a problem in that a considerably high total cost is incurred to obtain a wide operational bandwidth. In addition, since a plurality of antennas, each of which is relatively large, is used, the antennas are necessarily attached to the exterior of the vehicle. Thus, there are risks in that the antennas will be damaged or stolen. In addition, there is a problem in that the appearance of the vehicle is degraded.

SUMMARY OF THE INVENTION

In consideration of the above-described situation of the conventional technique, an object of the present invention is to provide an inexpensive and compact wideband antenna which is mountable in a vehicle cabin. In addition, it is also an object of the present invention to increase the working efficiency in an operation of connecting a coaxial cable.

To this end, an antenna of the present invention comprises a radiation conductor unit including an electricity-supplying conductor and a plurality of radiation conductors having different lengths which extend in parallel to each other from the electricity-supplying conductor; a grounded conductor unit which opposes the radiation conductors in an approximately parallel manner with a predetermined distance therebetween; and an insulating casing which contains the radiation conductor unit and the grounded conductor unit, and which is constructed of a main case and a cover which are able to sandwich a coaxial cable for supplying electricity. The radiation conductor unit and the grounded conductor unit are fixed to the main case, and a connecting part of an inner conductor of the coaxial cable and the electricity-supplying conductor and a connecting part of an outer conductor of the coaxial cable and the grounded conductor unit are covered with the cover.

According to the antenna which is constructed as described above, multiple resonances occur between the radiation conductors having different lengths and the grounded conductor unit. Accordingly, the overall frequency characteristics are improved in a frequency band including multiple resonance frequencies, and the operational bandwidth is increased. In addition, since the radiation conductors arranged in parallel to each other individually serve as radiators, the size of the antenna is reduced compared to conventional dipole antennas, so that the installation in a vehicle cabin can be realized. In addition, the coaxial cable for supplying electricity is sandwiched by the main case and the cover which construct the casing, and the connecting part of the coaxial cable and the electricity-supplying conductor and the connecting part of the coaxial cable and the grounded conductor unit are covered with the cover. Accordingly, the operation of connecting the coaxial cable is easily performed while the cover is removed, so that the working efficiency is increased. Preferably, in the above-described construction, the electricity-supplying conductor is provided with a first receiving portion to which the inner conductor of the coaxial cable is connected, and the grounded conductor unit is provided with a second receiving portion to which the outer conductor of the coaxial cable is connected. In addition, the first and the second receiving portions are preferably positioned at the same side of the antenna. In such a case, the position for setting the coaxial cable is clearly defined, so that the inner conductor and the outer conductor of the coaxial cable are more easily connected to the receiving portions.

Although the fist and the second receiving portions may be disposed in the same plane, the vertical distance between the first receiving portion and the grounded conductor unit is preferably larger than a vertical distance between the second receiving portion and the grounded conductor unit. In such a case, a step between the inner conductor and the outer conductor of the coaxial cable is compensated for, so that the coaxial cable may be installed in a horizontal manner, reducing the stress applied at the connecting parts.

Preferably, the coaxial cable is provided with a thickened portion, and the main case and the cover are provided with concavities for receiving the thickened portion. In such a case, even when exterior stress, such as tensile stress, bending stress, etc., is applied, the engaging part of the thickened portion and the concavities receives the stress. Such a stress-receiving construction prevents disconnection of the coaxial cable and maintains a condition in which the connection is stable.

Preferably, at least one of the radiation conductor unit and the grounded conductor unit is provided with a holding portion for holding the coaxial cable, and an end portion of the grounded conductor unit abuts against an inwardly facing side surface of the main case. In such a case, the abutting part of the grounded conductor unit and the inwardly facing side surface receive the tensional stress applied to the coaxial cable. This construction also serves to prevent disconnection of the coaxial cable, so that disconnection of the coaxial cable is more reliably prevented. In addition, the radiation conductors in the radiation conductor unit, the first receiving portion provided to the electricity-supplying conductor, and the second receiving portion provided to the grounded conductor unit are stably positioned. Thus, impedance variation of the antenna containing these components is reduced. Accordingly, impedance matching between the antenna and the coaxial cable is ensured.

DESCRIPTION OF THE PREFERRED EMBODIMENTS

Figure 1:
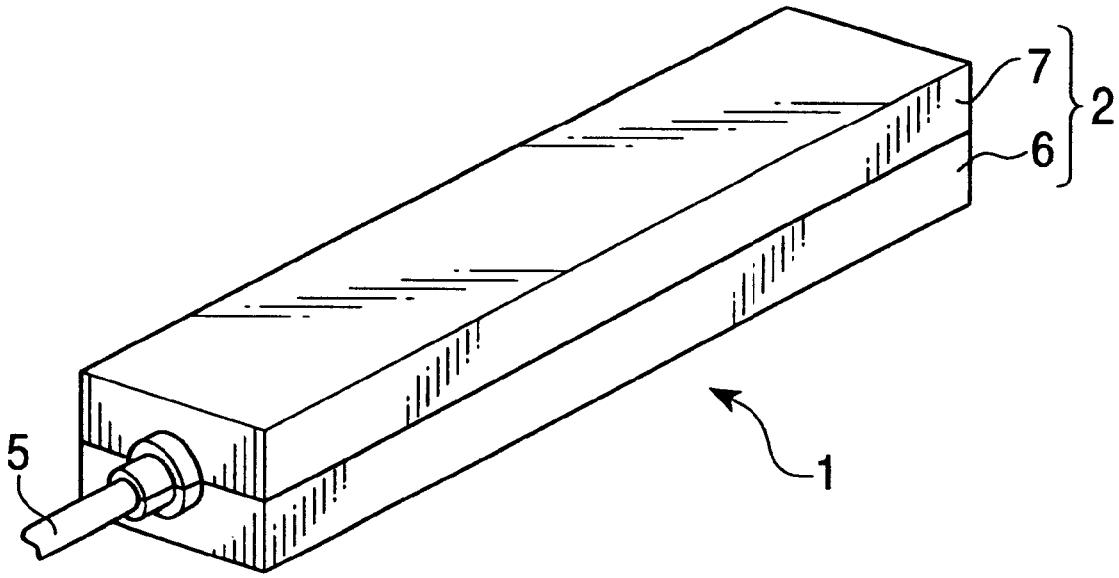
FIG. 1 is a perspective view of an antenna according to a first embodiment of the present invention.
Figure 2:
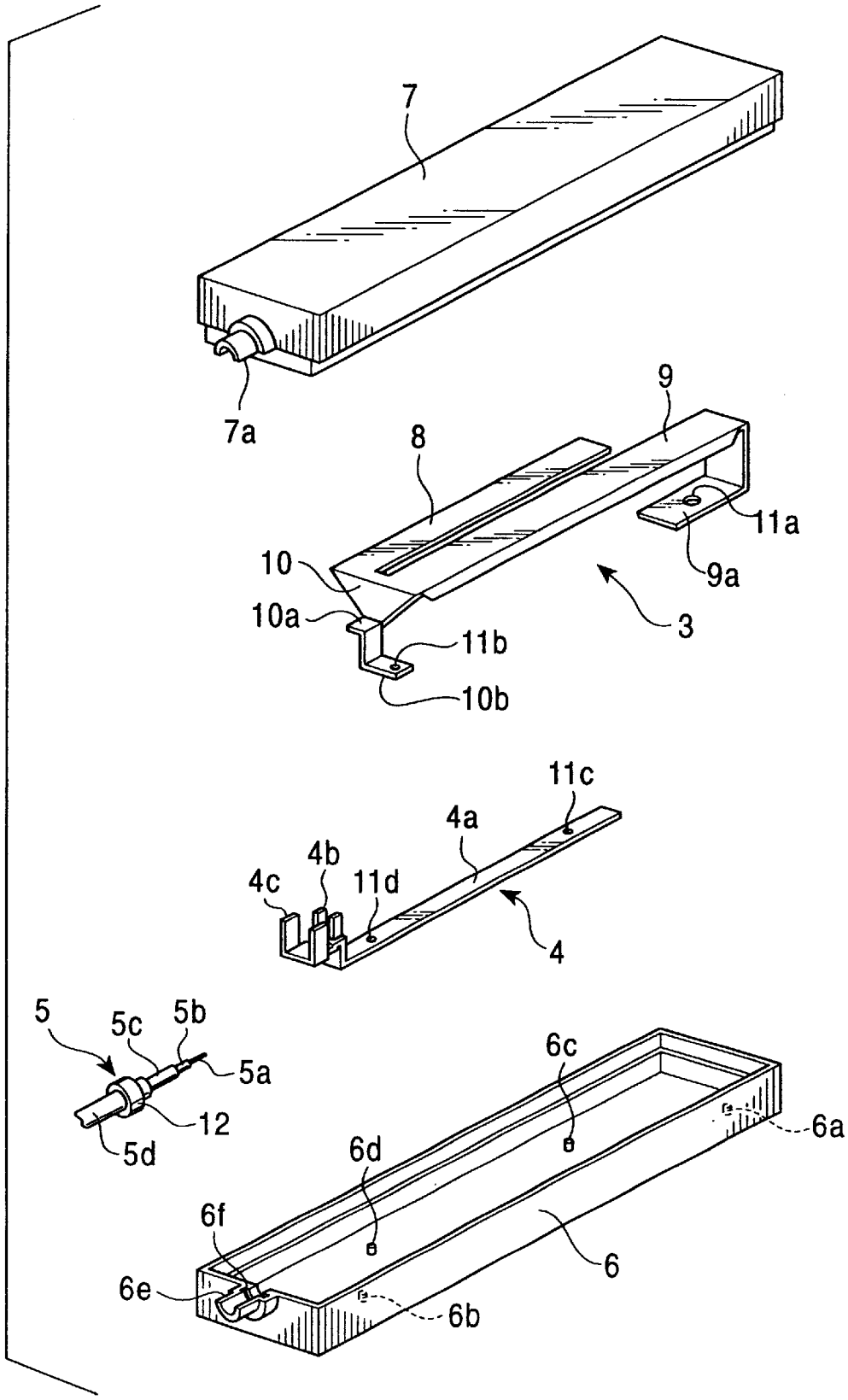
FIG. 2 is an exploded perspective view of the antenna shown in FIG. 1.
Figure 3:
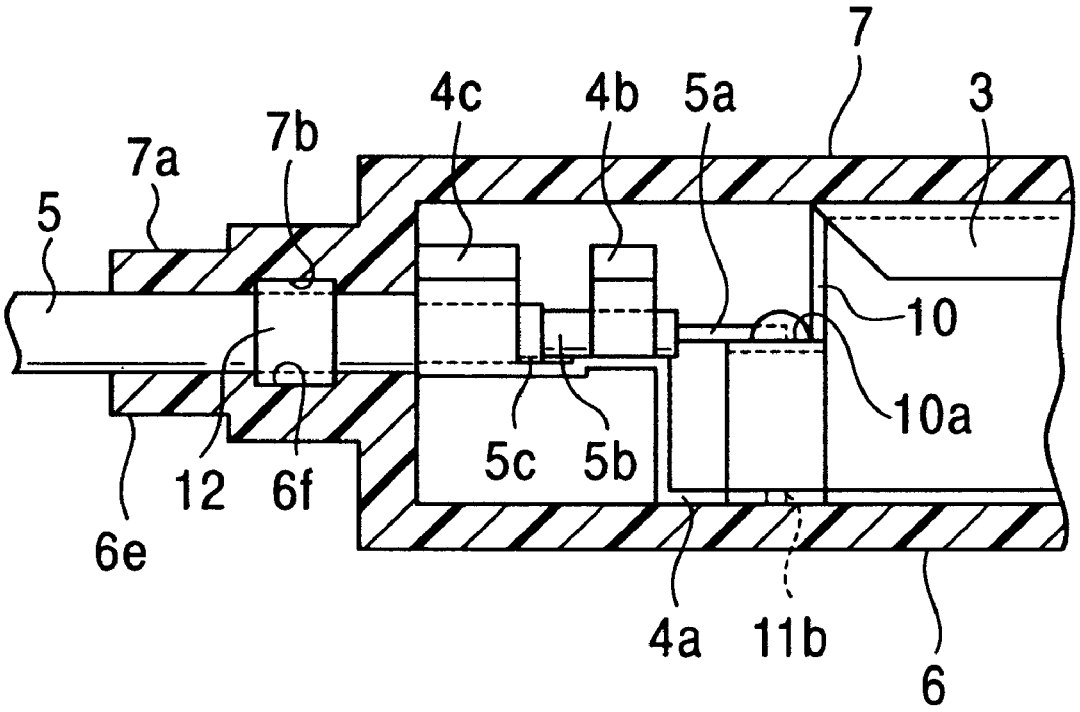
FIG. 3 is a sectional view of a connecting part of a coaxial cable and conductor units which are installed in the antenna shown in FIG. 1.
Figure 4A:
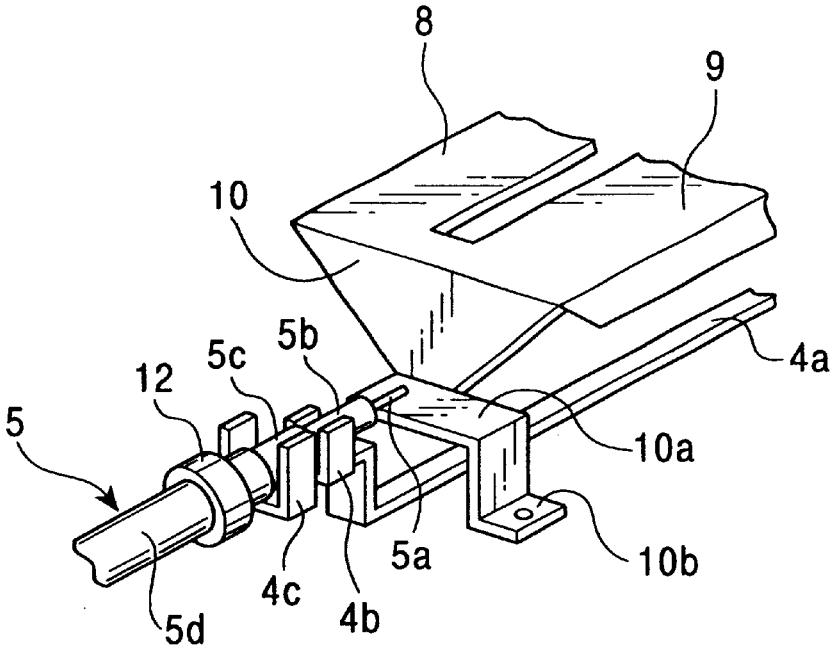
FIG. 4A and FIG. 4B are perspective views showing the connecting part of the coaxial cable and the conductor units which are installed in the antenna shown in FIG. 1.
Figure 4B:
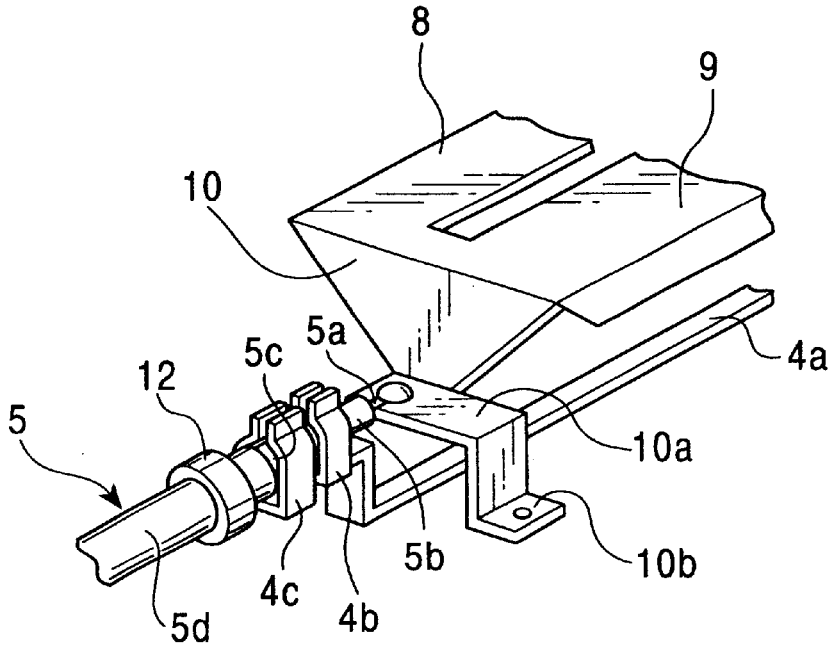

Embodiments of the present invention will be described below in conjunction with the accompanying drawings. FIG. 1 is a perspective view of an antenna 1 according to a first embodiment of the present invention, and FIG. 2 is an exploded perspective view of the antenna 1. The antenna 1 includes a casing 2 which functions as an outer shell of the antenna 1, a radiation conductor unit 3, a grounded conductor unit 4, and a coaxial cable 5. The radiation conductor unit 3 and the grounded conductor unit 4 are installed in the casing 2, and the coaxial cable 5 is connected thereto. Accordingly, the radiation conductor unit 3 and the grounded conductor unit 4 are supplied with electricity via the coaxial cable 5, which is led out from the casing 2. FIG. 3 is a sectional view of a part in which the coaxial cable 5 is connected to the conductor units 3 and 4. In addition, FIG. 4A and FIG. 4B are perspective views of the part in which the coaxial cable 5 is connected to the conductor units 3 and 4.

The casing 2 is constructed by fixing and joining a first case 6 and a second case 7, which are constructed of an insulating and heat-resistant material such as ABS plastic. The first case 6 has the shape of an open container, and functions as a main case. Four projections 6*a* to 6*d* are formed on the inwardly facing bottom surface of the first case 6, and a semicircular tube 6*e* is formed at the upper edge of one end surface. The semicircular tube 6*e* is provided with a concavity 6*f* having a larger inside diameter compared to other parts thereof. On the other hand, the second case 7 has the shape of an inverted open container, and functions as a cover. A semicircular tube 7*a* is formed at the lower edge of one end surface of the second case 7, and is provided with a concavity 7*b* having a larger inside diameter compared to other parts thereof(see FIG. 3).

The radiation conductor unit 3 includes a first radiation conductor 8, a second radiation conductor 9, and an electricity-supplying conductor 10. The radiation conductors 8 and 9 have different lengths and are arranged in parallel to each other. The electricity-supplying conductor 10 is connected to each of the radiation conductors 8 and 9 at one longitudinal end thereof. The radiation conductors 8 and 9 and the electricity-supplying conductor 10 are integrally formed by bending a plate constructed of a highly conductive metal such as Cu, Al. etc. A slit-shaped clearance is formed between the first and the second radiation conductors 8 and 9, and the first radiation conductor 8 extends along this clearance in the form of a plate. The second radiation conductor 9 also extends in the form of a plate, but is longer relative to the first radiation conductor 8. The leading end of the second radiation conductor 9 is bend in the shape of a bracket, forming an attachment tab 9*a* having an insertion hole 11*a*. In addition, a first receiving portion 10*a* and an attachment tab 10*b* having an insertion hole 11*b*, which are integrally formed in the shape of a step, are provided at the end of the electricity-supplying conductor unit 10. The first receiving portion 10*a* is provided for electrically connecting an inner conductor 5*a* of the coaxial cable 5 thereto, and has a horizontal surface which is parallel to the radiation conductors 8 and 9. The attachment tab 10*b* is used in combination with the attachment tab 9*a* formed at the end of the second radiation conductor 9 to fix the radiation conductor unit 3 on the inwardly facing bottom surface of the first case 6. The attachment tab 9*a* and the attachment tab 10*b* are formed in the same plane.

The grounded conductor unit 4 includes a grounded conductor 4*a* which extends in a linear manner, a holding portion 4*b* which is connected to an end of the grounded conductor 4*a*, and a second receiving portion 4*c*. The grounded conductor unit 4 is also integrally formed by bending a plate constructed of a highly conductive metal such as Cu, Al, etc. The grounded conductor 4*a* is provided with a pair of insertion holes 11*c* and 11*d*, which are used for fixing the grounded conductor unit 4 to the inwardly facing bottom surface of the first case 6. The holding portion 4*b* is used for holding an insulator 5*b* of the coaxial cable 5, and is formed in the shape of a bracket so that the insulator 5*c* can be inserted therein. The second receiving portion 4*c* is provided for electrically connecting an outer conductor 5*c* of the coaxial cable 5 thereto, and is also formed in the shape of a bracket so that the outer conductor 5*c* can be inserted therein. The holding portion 4*b* and the second receiving portion 4*c* are formed in a manner such that the upwardly facing bottom surfaces thereof are in parallel to the grounded conductor 4*a*. In addition, as shown in FIG. 3, the vertical distance between the grounded conductor 4*a* and the upwardly facing bottom surface of the holding portion 4*b* is set to be larger than the vertical distance between the grounded conductor 4*a* and the upwardly facing bottom surface of the second receiving portion 4*c*.

The projections 6*a* to 6*d* are respectively inserted through the insertion holes 11*a* and 11*b* formed in the radiation conductor unit 3 and the insertion holes 11*c* and 11*d* formed in the grounded conductor unit 4. The radiation conductor unit 3 and the grounded conductor unit 4 are fixed to the inwardly facing bottom surface of the first case 6 by deforming the ends of the projections 6*a* to 6*d*, by using an adhesive, or by other means. The grounded conductor 4*a* of the grounded conductor unit 4 is fixed to the inwardly facing bottom surface of the first case 6 at the center. The first and the second radiation conductors 8 and 9 of the radiation conductor unit 3 are disposed above the grounded conductor 4*a* and oppose the grounded conductor 4*a* across an air gap whose permittivity is 1. The first receiving portion 10*a* formed at the end of the electricity-supplying conductor 10 in the radiation conductor unit 3 and the holding portion 4*b* and the second receiving portion 4*c* formed in the grounded conductor unit 4 are positioned in an approximately linear manner as seen from the top of the first case 6. As shown in FIG. 3, however, the first receiving portion 10*a*, the holding portion 4*b*, and the second receiving portion 4*c* are arranged so as to form steps in the vertical direction. The first receiving portion 10*a* is disposed at the highest position relative to the inwardly facing bottom surface of the first case 6. The holding portion 4*b* is disposed at a lower position relative to the first receiving portion 10*a*, and the distance therebetween corresponds to the thickness of the insulator 5*b*. The second receiving portion 4*c* is disposed at a position still lower relative to the holding portion 4*b*, and the distance therebetween corresponds to the thickness of the outer conductor 5*c*. In addition, the second receiving portion 4*c* formed at an end of the grounded conductor unit 4 abuts against an inwardly facing side surface of the first case 6. Accordingly, displacement of the holding portion 4*b* and the second receiving portion 4*c* toward the semicircular tube 6*e* (leftward in FIG. 3) is restrained.

The coaxial cable 5 is constructed by forming the insulator 5*b* and the outer conductor 5 around the inner conductor 5*a* disposed in the center, and is provided with a thickened portion 12 constructed of, for example, a heat-shrinkable tubing. The inner conductor 5*a* is connected to the first receiving portion 10*a* by soldering, and the outer conductor 5*c* is clamped by the second receiving portion 4*c*. Accordingly, the electricity-supplying conductor 10 and the grounded conductor 4*a* are supplied with electricity through the inner conductor 5*a* and outer conductor 5*c*. In addition, the insulator 5*b* of the coaxial cable 5 is clamped by the holding portion 4*b*, and the exterior 5*d* of the coaxial cable 5 is sandwiched by the semicircular tubes 6*e* and 7*a* of the first and the second cases 6 and 7. At this time, the thickened portion 12 is restrained in the concavities 6*f* and 7*b* formed in the semicircular tubes 6*e* and 7*a*.

Next, the fabrication process of the antenna 1 having the above-described construction will be explained below. First, the projections 6*a* to 6*d* are respectively inserted through the insertion holes 11*a* and 11*b* formed in the radiation conductor unit 3 and the insertion holes 11*c* and 11*d* formed in the grounded conductor unit 4. Then, the radiation conductor unit 3 and the grounded conductor unit 4 are fixed to the inwardly facing bottom surface of the first case 6 by deforming the ends of the projections 6*a* to 6*d*, by using an adhesive, or by other means. The coaxial cable 5 is then introduced from the upper side of the first case 6. As shown in FIG. 4A, the insulator 5*b* and the outer conductor 5*c* are inserted into the holding portion 4*b* and the second receiving portion 4*c*, respectively, and the inner conductor 5*a* at the leading end is put on the first receiving portion 10*a*. The exterior 5*d* of the coaxial cable 5 is fit in the semicircular tube 6*e* of the first case 6 in a manner such that the thickened portion 12 is restrained in the concavity 6*f*. Then, as shown in FIG. 4B, the insulator 5*b* is clamped and fixed by the holding portion 4*b*, and the outer conductor 5*c* is clamped and fixed by the second receiving portion 4*c*. Thus, the outer conductor 5*c* is electrically and mechanically connected to the second receiving portion 4*c*. The inner conductor 5*a* is soldered on and electrically connected to the first receiving portion 10*a*. In accordance with requirements, a solder may be applied on the connecting part of the outer conductor 5*c* and the second receiving portion 4*c* to ensure reliability. In addition, the connections between the insulator 5*b* and the holding portion 4*b* and between the outer conductor 5*c* and the second receiving portion 4*c* may also be performed by other means, for example, by press fitting. Lastly, the opening at the upper side of the first case 6 is covered by the second case 7 in a manner such that the thickened portion 12 of the coaxial cable 5 is restrained inside the concavity 7*b* of the second case 7. The first and the second cases 6 and 7 are then fixed to each other by snaps, screws, an adhesive, or by other means. Accordingly, the fabrication of the antenna 1 as shown in FIG. 1 is completed. The radiation conductor unit 3 and the grounded conductor unit 4 are contained in the casing 2, and the coaxial cable 5 for supplying electricity is led out therefrom through the semicircular tubes 6*e* and 7*a* of the first and the second cases 6 and 7.

According to the antenna 1 of the first embodiment, which is constructed as described above, multiple resonances occur between the first and the second radiation conductors 8 and 9 having different lengths and the grounded conductor 4*a* in the grounded conductor unit 4. Accordingly, overall frequency characteristics are improved in a frequency band including multiple resonance frequencies, and the operational bandwidth of the antenna 1 is increased. In addition, since the first and the second radiation conductors 8 and 9, which are arranged in parallel to each other, individually serve as radiators, the size of the antenna 1 is reduced, so that installation in a vehicle cabin can be realized. The coaxial cable 5 for supplying electricity is sandwiched by the first and the second cases 6 and 7 which construct the casing 2. In addition, the first receiving portion 10*a* in the radiation conductor unit 3 and the grounded conductor 4*a* in the grounded conductor unit 4 are first disposed in the first case 6, and are then covered by the second case 7. Accordingly, the operation of connecting the coaxial cable 5 is easily performed while the second case 7 is removed. In addition, various tests including a continuity test and a characteristic test may also be performed while the second case 7 is removed and the antenna 1 is not yet completed. Thus, the working efficiency in the fabrication process is increased.

The first receiving portion 10*a* for connecting the inner conductor 5*a* of the coaxial cable 5 thereto is provided at the end of the electricity-supplying conductor 10 in the radiation conductor unit 3. In addition, the second receiving portion 4*c* for connecting the outer conductor 5*c* of the coaxial cable 5 thereto is provided in the grounded conductor unit 4. Since the first and the second receiving portions 10*a* and 4*c* are arranged in a linear manner, the position for setting the coaxial cable 5 is clearly defined, so that the operation of connecting the coaxial cable 5 is easily performed. In addition, the first receiving portion 10*a*, the holding portion 4*b*, and the second receiving portion 4*c* are arranged so as to form steps in the vertical direction. The first receiving portion 10*a* is disposed at the highest position relative to the inwardly facing bottom surface of the first case 6. The holding portion 4*b* is disposed at a lower position relative to the first receiving portion 10*a*, and the distance therebetween corresponds to the thickness of the insulator 5*b*. The second receiving portion 4*c* is disposed at a position still lower relative to the holding portion 4*b*, and the distance therebetween corresponds to the thickness of the outer conductor 5*c*. According to such a construction, the steps between the inner conductor 5*a* and the outer conductor 5*c* are compensated for, so that the coaxial cable 5 may be installed in a horizontal manner, reducing the stress applied at the connecting parts.

In addition, the thickened portion 12 formed on the exterior 5*d* of the coaxial cable 5 is restrained inside the concavities 6*f* and 7*b* formed in the semicircular tubes 6*e* and 7*a* of the first and the second cases 6 and 7. Thus, even when exterior stress, such as tensile stress, bending stress, etc., is applied, the engaging part of the thickened portion 12 and the concavities 6*f* and 7*b* receives the stress. This construction, which will be referred to as a first stress receiving construction, prevents disconnection of the coaxial cable 5 and maintains a condition in which the connection is stable. In addition, the second receiving portion 4*c* abuts against the inwardly facing side surface of the first case 6, so that displacement of the holding portion 4*b* and the second receiving portion 4*c* toward the semicircular tube 6*e* is restrained. Accordingly, the abutting part of the second receiving portion 4*c* and the inwardly facing side surface of the first case 6 receive the tensile stress applied to the coaxial cable 5. This construction, which will be referred to as a second stress receiving construction, also serves to prevent disconnection of the coaxial cable 5. Since the first and the second stress receiving constructions are applied, disconnection of the coaxial cable 5 is more reliably prevented.

The radiation conductors 8 and 9 in the radiation conductor unit 3, the first receiving portion 10*a* in the electricity-supplying conductor 10, and the grounded conductor 4*a* and the second receiving portion 4*c* in the grounded conductor unit 4 are stably positioned. Thus, impedance variation of the antenna 1 containing these components is reduced. Accordingly, impedance matching between the antenna 1 and the coaxial cable 5 is ensured, so that the characteristics of the antenna 1 are improved.

In the above-described first embodiment, the holding portion 4*b* for holding the insulator 5*b* of the coaxial cable 5 was provided in the grounded conductor unit 4. The holding portion, however, may also be integrally formed with the first receiving portion 10*a* in the radiation conductor unit 3. In such a case, the inner conductor 5*a* and the insulator 5*b* are both connected to the first receiving portion 10*a*, so that the stress applied to the inner conductor 5*a* are reduced by the holding portion which holds the insulator 5*b*. Accordingly, even when the radiation conductor unit 3, to which the inner conductor 5*a* is connected, and the grounded conductor unit 4, to which the outer conductor 5*c* is connected, receive tensile stresses from different directions, the inner conductor 5*a* is reliably prevented from being cut.

Figure 5:
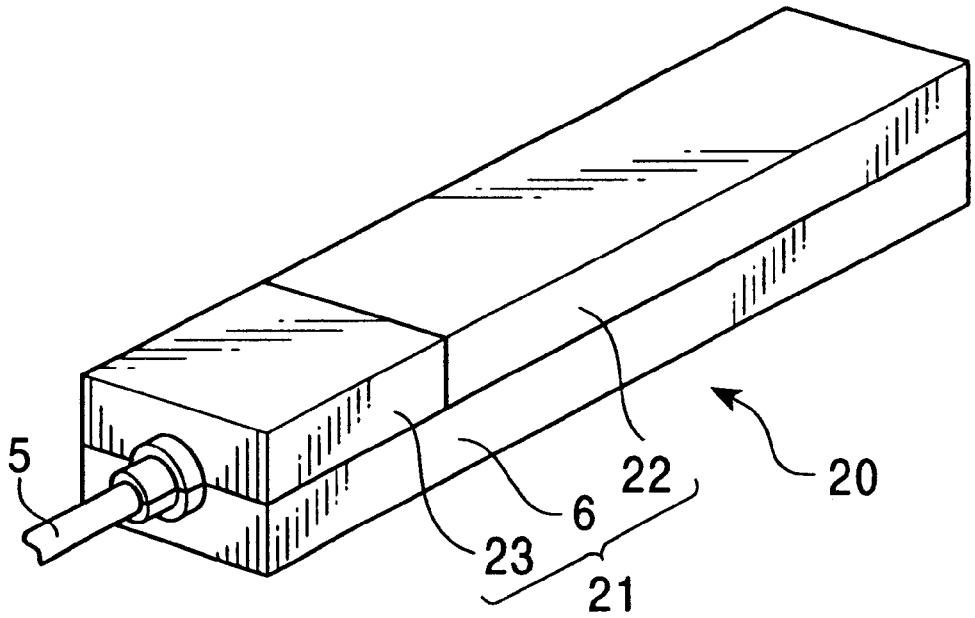
FIG. 5 is a perspective view of an antenna according to a second embodiment of the present invention.
Figure 6:
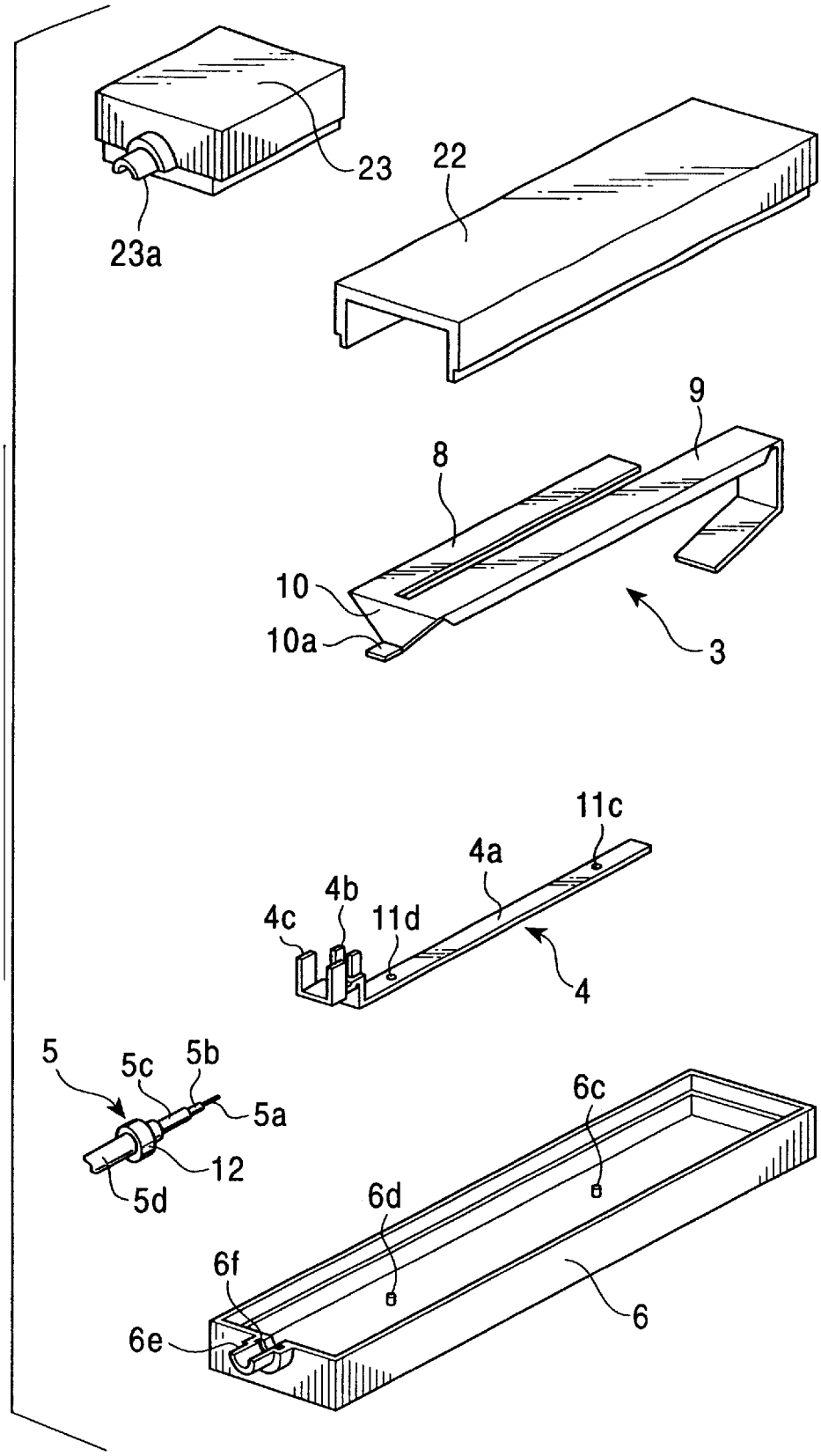
FIG. 6 is an exploded perspective view of the antenna shown in FIG. 5.
Figure 7:
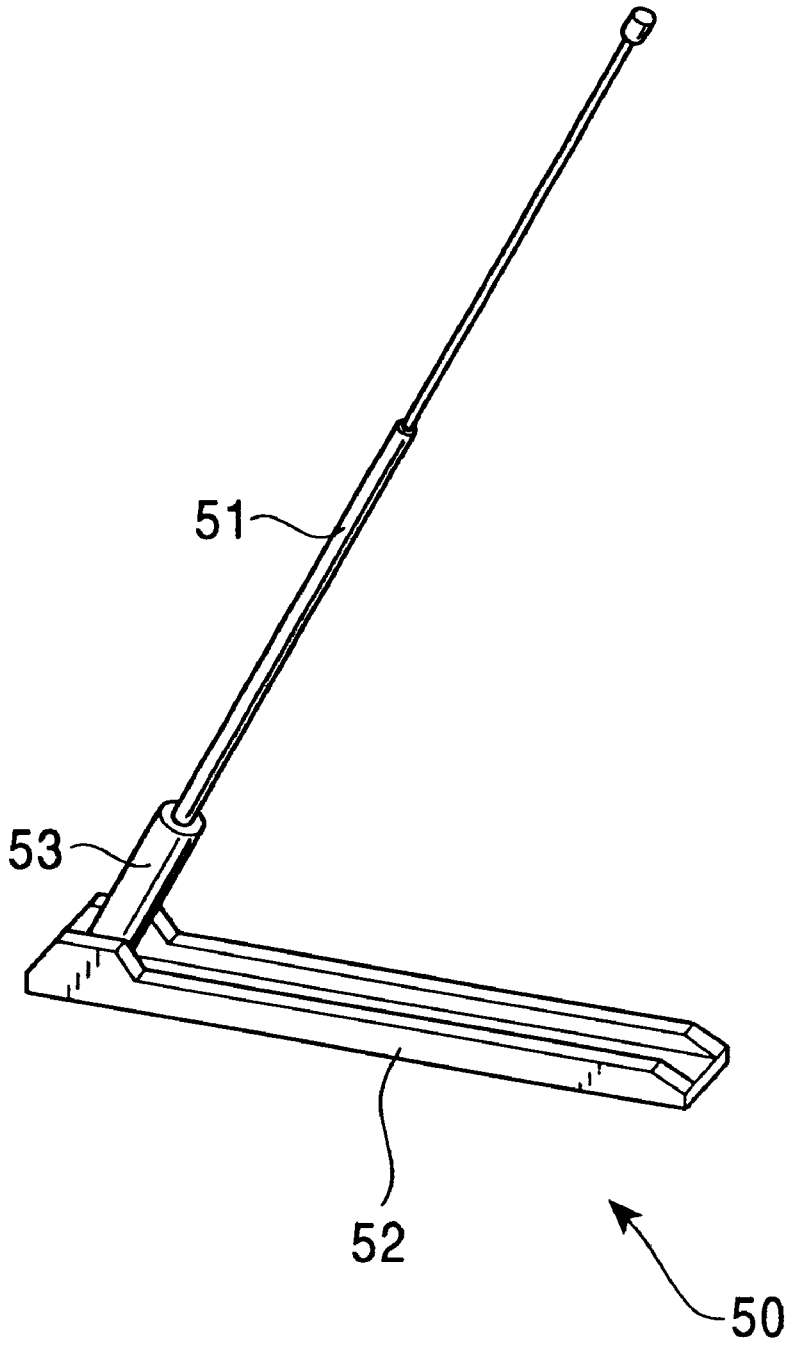
FIG. 7 PRIOR ART
FIG. 7 is a perspective view of a conventional on-board antenna.
Figure 8A:
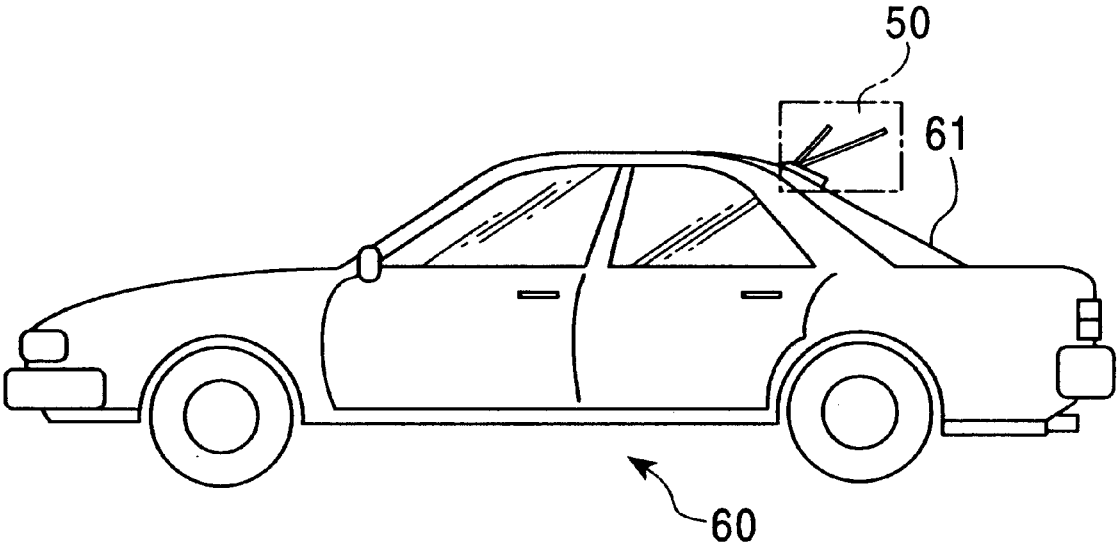
FIG. 8A PRIOR ART
FIGS. 8A and 8B are side views of a vehicle showing manners in which the conventional on-board antenna is mounted.
Figure 8B:
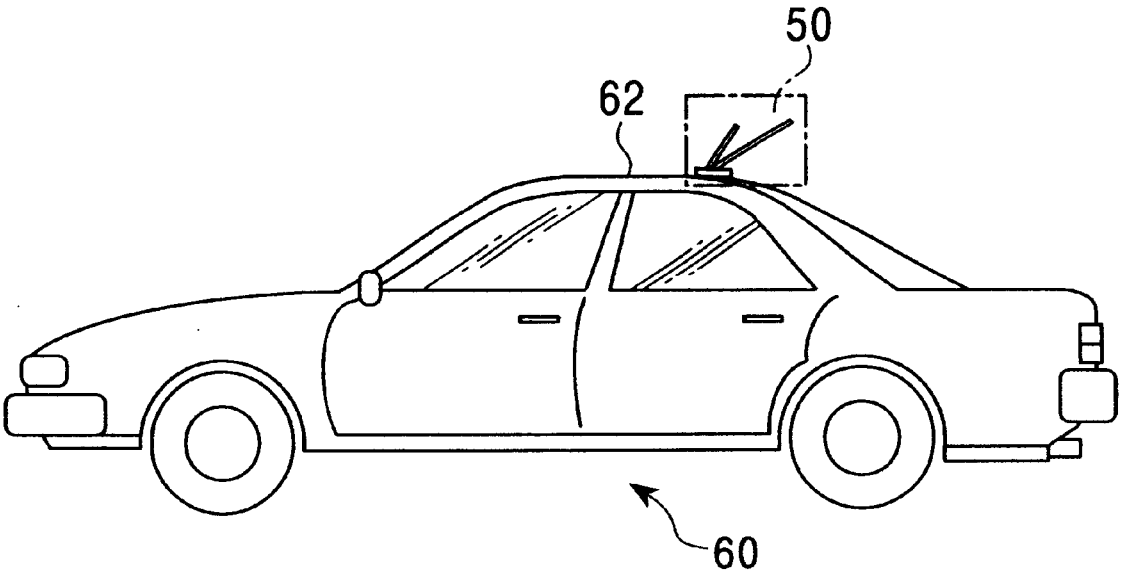
FIG. 8B PRIOR ART

FIG. 5 is a perspective view of an antenna 20 according to a second embodiment of the present invention, and FIG. 6 is an exploded perspective view of the antenna 20. Components corresponding to those shown in FIGS. 1 to 4 are denoted by the same reference numerals, and redundant explanations are thus omitted.

The antenna 20 of the second embodiment differs from the antenna 1 of the first embodiment in a point that a casing 21, which functions as an outer shell of the antenna 20, is constructed of three parts: the first case 6, a first divided case 22, and a second divided case 23. The first case 6 and the first divided case 22 function as a main case, and the second divided case 23 functions as a cover. More specifically, the grounded conductor unit 4 is fixed to the inwardly facing bottom surface of the first case 6, and the radiation conductor unit 3 is fixed inside the first divided case 22, which covers most parts of the opening at the upper side of the first case 6. The first case 6 and the first divided case 22 are fixed to each other and joined so as to form the main case before the coaxial cable 5 is connected. Since the radiation conductor unit 3 is fixed inside the first divided case 22, some of the insertion holes and attachment tabs are omitted. Other parts of the radiation conductor unit 3, however, are constructed in the same manner as described in the first embodiment. The remaining part of the opening at the upper side of the first case 6 which is not covered by the first divided case 22, is covered by the second divided case 23. A semicircular tube 23*a* is formed at the lower edge of the end surface of the second divided case 23 for sandwiching the exterior 5*d* of the coaxial cable 5 with the semicircular tube 6*e* of the first case 6. Although not shown in the figure, a concavity for restraining the thickened portion 12 is formed inside the semicircular tube 23*a*.

Next, the fabrication process of the antenna 20 having the above-described construction will be explained below. First, the projections 6*c* and 6*d* formed in the first case 6 are inserted through the insertion holes 11*c* and 11*d* formed in the grounded conductor unit 4. The grounded conductor unit 4 is then fixed to the inwardly facing bottom surface of the first case 6 by deforming the front ends of the projections 6*c* and 6*d*. The first and the second radiation conductors 8 and 9 in the radiation conductor unit 3 are fixed inside the first divided case 22 by applying an adhesive or by other means. Then, the first case 6 and the first divided case 22 are fixed to each other by snaps, screws, an adhesive, or by other means, so as to form the main case. At this time, most parts of the radiation conductor unit 3 and the grounded conductor unit 4 are disposed inside the first case 6 and the first divided case 22. Some parts of the opening at the upper side of the first case 6, however, remain uncovered. Thus, the first receiving portion 10*a* formed at the end of the electricity-supplying conductor 10 in the radiation conductor unit 3 and the holding portion 4*b* and second receiving portion 4*c* formed in the grounded conductor unit 4 face outside through the uncovered parts of the opening. The coaxial cable 5 is then introduced from the upper side of the first case 6. In a similar manner as described in the first embodiment, the inner conductor 5*a* at the leading end is put on the first receiving portion 10*a*, and the insulator 5*b* and the outer conductor 5*c* are inserted into the holding portion 4*b* and the second receiving portion 4*c*, respectively. The exterior 5*d* of the coaxial cable 5 is fit in the semicircular tube 6*e* of the first case 6 in a manner such that the thickened portion 12 is restrained in the concavity 6*f*. Then, the insulator 5*b* is clamped and fixed by the holding portion 4*b*, and the outer conductor 5*c* is clamped and fixed by the second receiving portion 4*c*. Thus, the outer conductor 5*c* is electrically and mechanically connected to the second receiving portion 4*c*. The inner conductor 5*a* is soldered on and electrically connected to the first receiving portion 10*a*. Lastly, the first case 6 is covered by the second divided case 23, and they are fixed by snaps, screws, an adhesive, or by other means. Accordingly, the fabrication of the antenna 20 as shown in FIG. 5 is completed. The radiation conductor unit 3 and the grounded conductor unit 4 are contained in the casing 21, and the coaxial cable 5 for supplying electricity is led out therefrom through the semicircular tubes 6*e* and 23*a* of the first case 6 and the second divided case 23.

According to the antenna 20 of the second embodiment, which is constructed as described above, the operation of connecting the coaxial cable 5 and various tests can be performed while the second divided case 23, which functions as a cover, is removed. Thus, effects as described in the first embodiment are obtained.

What is claimed is:

1. An antenna comprising:

a radiation conductor unit including an electricity-supplying conductor and a plurality of radiation conductors having different lengths which extend in parallel to each other from said electricity-supplying conductor;

a grounded conductor unit which opposes said plurality of radiation conductors in an approximately parallel manner with a predetermined distance therebetween; and an insulating casing which contains said radiation conductor unit and said grounded conductor unit, and which is constructed of a main case and a cover which are able to sandwich a coaxial cable for supplying electricity, wherein said radiation conductor unit and said grounded conductor unit are fixed to said main case, and wherein a connecting part of an inner conductor of said coaxial cable and said electricity-supplying conductor and a connecting part of an outer conductor of said coaxial cable and said grounded conductor unit are covered with said cover.

2. An antenna according to claim 1, wherein said electricity-supplying conductor is provided with a first receiving portion to which the inner conductor of said coaxial cable is connected, wherein said grounded conductor unit is provided with a second receiving portion to which the outer conductor of said coaxial cable is connected, and wherein said first receiving portion and said second receiving portion are positioned in the same direction of said antenna.

3. An antenna according to claim 2, wherein a vertical distance between said first receiving portion and said grounded conductor unit is larger than a vertical distance between said second receiving portion and said grounded conductor unit.

4. An antenna according to claim 1, wherein said coaxial cable is provided with a thickened portion at an exterior of said coaxial cable, and wherein said main case and said cover are provided with concavities for receiving said thickened portion.

5. An antenna according to claim 1, wherein at least one of said radiation conductor unit and said grounded conductor unit is provided with a holding portion for holding said coaxial cable, and wherein an end portion of said grounded conductor unit abuts against an inwardly facing side surface of said main case.

* * * * *

UNITED STATES PATENT AND TRADEMARK OFFICE

CERTIFICATE OF CORRECTION

PATENT NO. : 6,310,586 B1 
DATED : October 30, 2001
INVENTOR(S) : Toshiyuki Takahashi et al.

It is certified that error appears in the above-identified patent and that said Letters Patent is hereby corrected as shown below:

Title page,
Item [30], Foreign Application Priority Data, delete "12-057235" and substitute -- 2000-057235 -- in its place.
Item [56], References Cited, FOREIGN PATENT DOCUMENTS, delete "12-040908' and substitute -- 2000-040908 -- in its place.

Signed and Sealed this

Seventeenth Day of September, 2002

*Attest:*

*Attesting Officer*

JAMES E. ROGAN
*Director of the United States Patent and Trademark Office*